US005702207A

United States Patent [19]

Hoffmann

[11] Patent Number: 5,702,207

[45] Date of Patent: Dec. 30, 1997

[54] PROCESS FOR REINFORCING SLOPES

[76] Inventor: Jürgen Hoffmann, Menzelstr. 22, D-12157 Berlin, Germany

[21] Appl. No.: 499,733

[22] Filed: Jul. 7, 1995

[30] Foreign Application Priority Data

Jul. 9, 1994 [DE] Germany ..... 44 24 212.3

[51] Int. Cl.[6] ..... E02D 17/20

[52] U.S. Cl. ..... 405/258

[58] Field of Search ..... 405/258, 15, 284; 47/83

[56] References Cited

U.S. PATENT DOCUMENTS 4,665,647 5/1987 Behrens et al. ..... 47/83 X

FOREIGN PATENT DOCUMENTS 0-216-422 9/1986 European Pat. Off. .

WO 84/01791 5/1984 WIPO ..... 47/83

OTHER PUBLICATIONS

Brunsden and Prior, Slope Instability, Library of Congress, John Wiley & Sons, pp. 27–65. 1984.

W. Begemann, May 1976, Slope Stabilization with Stabilizing Vegetation, Tiefbau, No. 5.

W. Begemann, May 1978, Stabilization of Slopes in Loose Rocks and Rocks with Vegetation, Tiefbau, No. 5.

Excerpt from *Grundbau–Taschenbuch* [Pocketbook of Foundation Engineering], Part 3, 3rd edition, Verlag Ernst & Sohn, Berlin 1987.

Woodtli, Erfahrungen mit Lebendverbaumethoden, Route et Trafic No. 4, Apr. 13, 1995, pp. 134–139.

Demyanov Ostapenko, Database WPI, Derwent Publns., 1 p.

Vidal, Reinforced earth: A new material material for civil engineering construction. Building Science Abstracts Nov., 1996, 1 p.

*Primary Examiner*—Tamara L. Graysay
*Assistant Examiner*—Tara L. Mayo
*Attorney, Agent, or Firm*—McGlew and Tuttle

[57] ABSTRACT

A process for reinforcing slopes, in which the strength of the slope can be calculated and is durable, and damaging after-effects are avoided. Live plants and/or plant parts forming adventitious roots are used for this purpose, and their minimum diameter, their depth of introduction and modular dimension are determined by means of calculation methods known from soil mechanics depending on the slope angle and the properties of the material of the slope.

4 Claims, 1 Drawing Sheet

PROCESS FOR REINFORCING SLOPES

FIELD OF THE INVENTION

The present invention pertains to a process for reinforcing slopes with live plants and/or plant parts forming adventitious roots.

BACKGROUND OF THE INVENTION

Non-reinforced slopes tend to slide down due to the tensile and shear forces that occur, especially when external forces from the top edge of the terrain additionally act on the slope. These forces occur, e.g., due to the weight of buildings built on the top edge of the terrain or trains traveling over the top edge of the terrain. The forces, which may lead to the sliding down of the slope, depend on the steepness and the nature of the slope.

It has been known that slopes can be prevented from sliding down by driving nails into the ground. Ground or rock nailing represents support structures which act as composite bodies. Nailed walls consist of three elements, namely, the outcropping ground or rock, the steel or plastic rods introduced, and a thin protective skin on the front side of the wall. The ground is cut at levels from top to bottom for this purpose, and the exposed wall surface is rapidly secured with air-placed concrete. After setting of the air-placed concrete, the nails with a rod diameter of approx. 20–30 mm are introduced into the ground usually approximately at right angles to the wall surface. This can be performed by pile driving, drilling, flushing or vibration. To guarantee a sufficient bond between the nail and the ground, the annular space formed by the drilling is filled with cement mortar, and pressed. After setting of the cement mortar, the head of the nail is to be connected to the air-placed concrete skin in a non-positive manner. A new layer may be cut immediately thereafter. The length of the nails normally corresponds to about 0.5–0.7 times the height of the wall, depending on the properties of the ground or rock, the geometric conditions, and external loads. Ground or rock nailing has been frequently used since about 1970, mainly in the Austrian Alps. The process, which was based only on empirical dimensioning formulas before, was improved in the course of the past few years into a process that can be calculated according to static methods (Grundbau-Taschenbuch [Pocketbook of Foundation Engineering], Part 3, 3rd edition; Verlag Ernst & Sohn, Berlin 1987). The use of non-natural construction materials, which represents a considerable interference with the natural balance, is disadvantageous in this process. For example, the thin air-placed concrete skin acts like a seal on the ground. Rainwater can no longer seep into the ground through the air-placed concrete skin, as a consequence of which it runs off the slope, where it must be drained via a sewer system, so that it is removed from the groundwater circulation. Moreover, the materials used are subject to the usual wear processes, e.g., corrosion, so that the quality of the slope reinforcement decreases over time.

Another possibility of reinforcing slopes is terracing. With terracing live plants are planted in the slope. In the case of terracing with hedges, rooted plants are placed on a retreat or terrace having a depth of 0.5 to 0.7 m, whose horizontal surface rises at least 10% to the outside, so densely to one another that they project above the soil level about one third of the entire length. Broad-leaved species, which are resistant to being buried and are able to form adventitious roots, are preferred. Another variant is terracing with bushes. Beginning from the bottom of the slope, ditches or terraces with a width of 50 to 100 cm are dug. Their soil level shall rise at least 10° to the outside in order for the branches to take root later over their entire length. The bushes are planted on these terraces such that branches with a length of at least 1 m will project only over one fifth to one fourth of their total length. The branches are crossed over rather than placed in parallel to ensure that the longest possible pieces will be covered by earth. To obtain root levels of different depths and to achieve the most uniform growth possible, not only different plant species, but also different age phases and branch thicknesses are mixed. The lower ditch is filled up with the dirt excavated from the ditch located above it. Terracing with bushes is much more simple on embankments. The outside of the embankments is always designed with a gentle rise against the slope. The bushes are placed on these outermost strips of the embankment, and buried. Branches with a length of several meters can be placed on embankments, as a result of which an extraordinarily deep-reaching strength is achieved without any significant extra cost. The strength increases further due to the subsequent root formation (Grundbau-Taschenbuch [Pocketbook of Foundation Engineering], Part 3, 3rd edition; Verlag Ernst & Sohn, Berlin 1987). Another possibility of reinforcing slopes is terracing with hedge bushes, which corresponds to a combination of the above two types of terracing. The disadvantage of all terracing processes is the lack of predictability of strength. However, predictability is absolutely necessary precisely for structures on the top edge of a slope or in front of the bottom of an embankment, to ensure that these will not slide down together with the slope and that they will not be buried by the slope sliding down. This also applies, of course, to persons who are on or under the slope.

SUMMARY AND OBJECTS OF THE INVENTION

It is an object of the present invention therefore to provide a process for reinforcing slopes, in which the strength of the slope can be calculated and is durable, and damaging after-effects are avoided.

According to the invention, a process is provided for reinforcing slopes with live plants and/or plant parts forming adventitious roots. The minimum diameter, the depth of introduction and the modular dimension of the plants and/or plant parts which are used are determined by means of calculation methods known from soil mechanics, depending on the slope angle and the properties of the material of the slope. The process may be advantageously used to reinforce sound barrier earth walls. By calculating the minimum diameter of the live plants and/or plant parts forming adventitious roots, their length and modular dimension by means of calculation methods known from soil mechanics, it is possible to achieve mathematically demonstrable, durable slope reinforcements with vegetation-strengthened ground. The slope strength achieved as a result is immediately fully effective. The strength of the slope is additionally increased by the subsequent root formation and the associated growth in thickness. Root formation is important only for the nutrient supply of the live plants to ensure that they will not die and rot. Root formation is only a favorable secondary effect for the direct slope reinforcement. The plant parts are arranged in the ground in layers in such amounts and with such cross sections per $m^2$ of surface area that the soil mechanical rupture properties of the ground will be disturbed such that the ground will react as a monolith.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE shows a schematic representation of a support body in the form of a slope reinforcement fortified by branches and twigs.

DESCRIPTION OF THE PREFERRED EMBODIMENT

Figure 1:
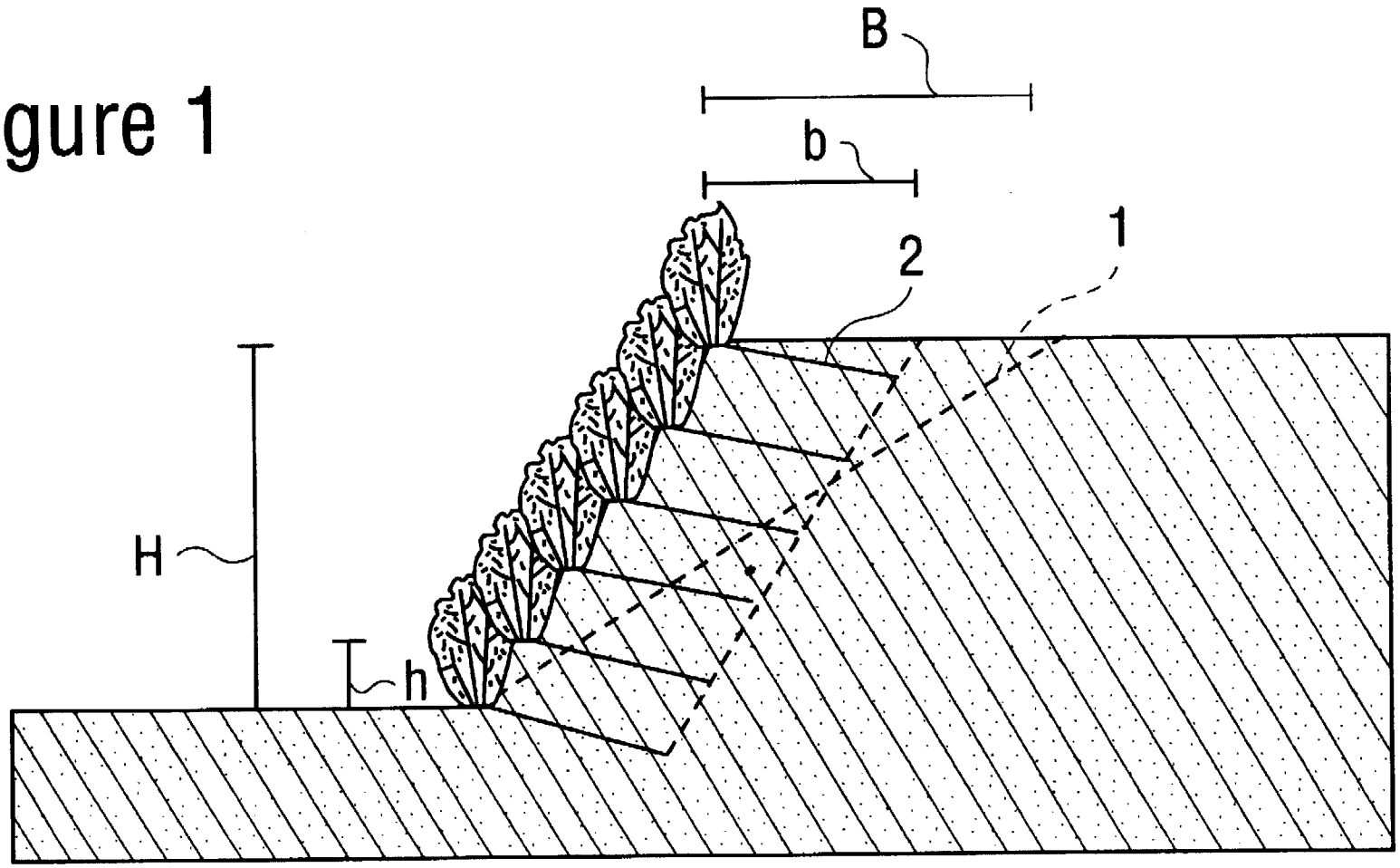

FIG. 1 shows a slope of a height H, which is to be reinforced. Without reinforcement, a maximum fracture surface 1 with a maximum width B, which is located at the top edge of the slope, occurs due to the tensile and shear forces that occur. The soil mechanical rupture properties of the slope are disturbed by specifically introducing twigs and branches 2 at depth b of the slope such that the slope will react like a composite body. The depth b of the twigs and branches, as well as the distance h of the planting retreats depends on the slope angle, the height and the properties of the material of the slope. The relationships will be illustrated on the basis of a numerical example.

Let us assume a slope of a height H (H=10 m) and a slope angle of 45°. The properties of the material of the slope shall be determined by the specific gravity of 19 $kN/m^3$, an apparent cohesion of 1 $kN/m^2$, a natural angle of incline of the ground of 32.5°, and an internal stability of 1.4. The parameters available for varying the quality of the slope strength are the distance between the planting retreats, the depth of penetration b, the mean thickness, the slope angle, and the number of twigs and branches 2 per running meter of planting retreat. Thereby, the biological limits of the individual parameters should be taken into account. At a depth of penetration b of 2 m, a mean thickness of 0.05 m and a slope angle of 10° of the twigs and branches, and a distance h of 0.5 m of the planting retreats, the number of twigs and branches to be used is calculated to be 11 per running meter of plant retreat, i.e., 220 twigs and branches 2 per running meter of slope to obtain a slope angle of 42° of the limiting rupture surface, i.e., smaller than the slope angle of 45° of the slope. The difference of 3° is necessary to maintain the safety margin specified by the DIN (Deutsche Industrie Normen) specifications. The distance between individual parallel twigs and branches 2 in one planting retreat should be at least 0.02 m to prevent mutual adverse effects. The number of twigs and branches per running meter of planting retreat is thus limited as well.

The process is used preferably for slopes formed by embankments, because the plants and/or plant parts can thus be introduced in an especially simple manner. However, it is also suitable for already existing slopes.

If individual plants or plant parts fail to grow, they must be replaced with new plants or plant parts. However, once all plants have grown, the loss of individual plants due to age is more than compensated by the growth of new young plants. An ecological balance becomes established.

Slopes with angles of up to 70° can be reinforced according to this process, so that it is also suitable for reinforcing sound barrier earth walls, besides the reinforcement of slopes and embankments.

What is claimed is:

1. A process for reinforcing slopes with at least one of live plants and plant parts forming adventitious roots, the process comprising the steps of:

making soil mechanics calculations based on a known slope height, the specific gravity of the material of the slope, an apparent cohesion of the slope, a natural incline of the slope and the internal stability of the slope to determine a potential slope strength; and reinforcing the slope to achieve said potential slope strength by determining a minimum diameter of said at least one of live plants and plant parts based on said step of making soil mechanics calculations, determining a minimum depth of introduction of said at least one of live plants and plant parts based on said step of making soil mechanics calculations, and determining a modular dimension of said at least one of live plants and plant parts based on said step of making soil mechanics calculations defining a plurality of planting retreats and introducing said at least one of live plants and plant parts into said slope, at said planting retreats, of a diameter at least bigger than said minimum diameter, at a depth at least greater than said minimum depth and with substantially said modular dimension.

2. A process according to claim 1, wherein said reinforcing slope is provided to reinforce sound barrier earth walls.

3. A method of forming a reinforcing slope, comprising: using at least one of live plants and plant parts forming adventitious roots; calculating a minimum diameter and a depth of introduction of said at least one of live plants and plant parts; and calculating the modular dimension based on the slope angle and properties of the material of the slope.

4. A process for reinforcing slopes, comprising:

determining the slope angle to be provided;

determining the properties of the material of the slope including the specific gravity, apparent cohesion, natural angle of incline of the ground and internal stability;

defining a plurality of planting retreats; and introducing said at least one of live plants and plant parts into the slope, at said planting retreats, at a depth based on a minimum diameter, a slope angle of said at least one of the plants and plant parts, a distance between planting retreats and a number of plant parts to provide a known slope strength.

* * * * *